United States Patent [19]

Göranson

[11] 4,239,146

[45] Dec. 16, 1980

[54] COLLAPSIBLE BOX WITH TWO COMPARTMENTS

[76] Inventor: Per S. Göranson, Lille Pers väg 4, S-311 00 Falkenberg, Sweden

[21] Appl. No.: 917,601

[22] Filed: Jun. 21, 1978

[30] Foreign Application Priority Data

Jul. 1, 1977 [SE] Sweden ..... 7707648

[51] Int. Cl.[3] ..... B65D 5/36

[52] U.S. Cl. ..... 229/15; 229/23 R; 229/52 B; 229/41 B; 206/200

[58] Field of Search ..... 229/15, 23 R, 52 B, 229/41 R, 41 B; 206/203, 200, 198; 220/6, 7, 22, DIG. 25

[56] References Cited

U.S. PATENT DOCUMENTS

| | | | |
|---|---|---|---|
| 1,051,274 | 1/1913 | Schmall | 220/7 |
| 1,620,585 | 3/1927 | Walther | 220/6 |
| 3,971,468 | 7/1976 | Helms et al. | 206/198 |

FOREIGN PATENT DOCUMENTS

| | | | |
|---|---|---|---|
| 740678 | 4/1970 | France | 220/6 |

*Primary Examiner*—Robert Louis Spruill
*Assistant Examiner*—K. Y. Lin
*Attorney, Agent, or Firm*—Beveridge, De Grandi, Kline & Lunsford

[57] ABSTRACT

A collapsible box has foldable wall-and-bottom assemblies which are connected to opposite sides of a central partition wall. Each wall-and-bottom assembly includes a main wall, a bottom panel pivoted to the lower edge of the main wall, and foldable sidewalls having one edge pivoted to the side edges of the main wall. The opposite edges of the foldable sidewalls are pivotally but detachably connected to the central partition wall.

5 Claims, 8 Drawing Figures

19
6
19
10
17'
6
21
18
22
14
8
18
8
12
15
7
13
14
16
9
11
20
7
17

8
10
22
12
15
17
6
18'
16
7
13
9
23
11

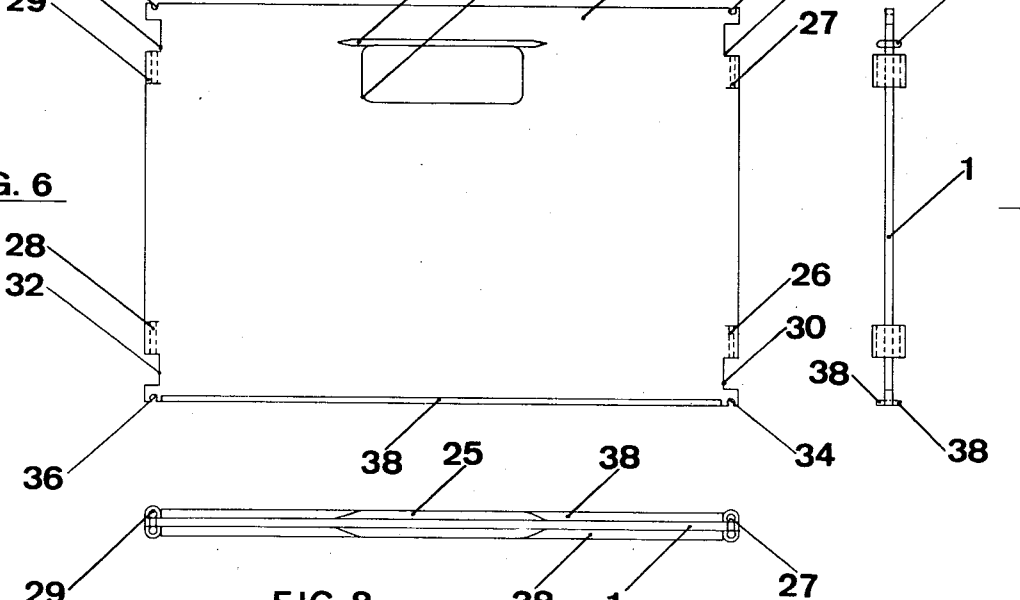
FIG. 7
FIG. 6
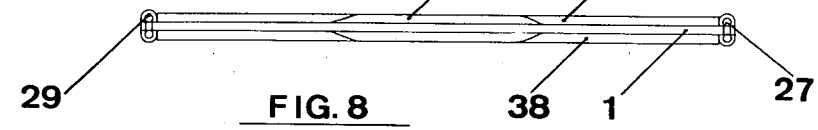
FIG. 8

COLLAPSIBLE BOX WITH TWO COMPARTMENTS

The present invention relates to an apparatus for forming a collapsible box with two compartments having a common partition wall.

There are many already known designs of collapsible boxes but all of them shows the drawback of having only one compartment provided of four vertical walls and a bottom. The four walls are pivotally connected to each other by hinges at the corners of the box and the bottom is pivotally connected to the underside of one of the walls and is having coupling means at the opposite side for cooperation with coupling means at the underside of the wall opposite the wall at which the bottom is connected. The coupling means are usually a few pins at the underside of the wall shiftable into holes in the bottom. Two opposing walls have apertures forming handgrips. To be able to lift and carry such a loaded box a person has to use both hands if an unbalanced situation should be avoided. Otherwise it is very difficult to walk with the loaded box in only one hand because of the unbalance.

The object of the present invention is to provide a collapsible box with two compartments and a design giving a person the possibility to lift and carry the loaded box by using only one hand without any problems with such unbalance as is created with already known boxes. The object of the present invention is also to provide a box which is easy to manufacture in plastics or any other suitable material.

According to the present invention the common partition wall is provided with means for connection of a wall and bottom element on each side of said partition wall, each of said wall and bottom elements comprising a main wall, a bottom pivotally connected to the main wall at the underside of the main wall and at each opposite side edge of the main wall, a foldable wall pivotally connected to said side edge of the main wall and provided with means for cooperation with said connection means on the partition wall at the side edge opposite the side edge connected to the main wall.

The present invention will be described in greater detail hereinbelow with reference to the accompanying drawings.

Figures 3, 4, 5:
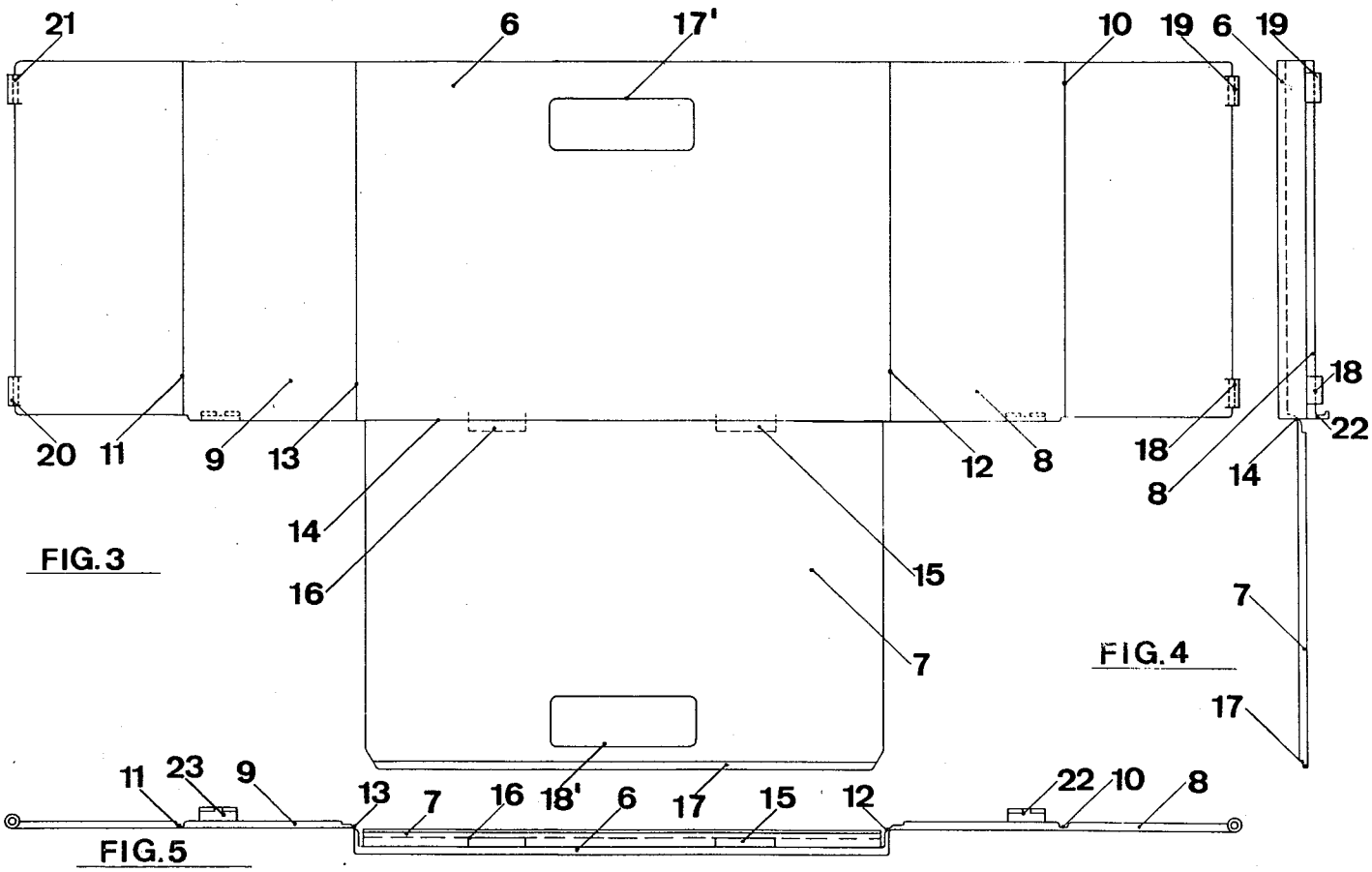
FIG. 3 shows a view of a wall and bottom element of a box according to the present invention.

FIG. 4 whows a side view of the element in FIG. 3.

FIG. 5 shows a view of the element in FIG. 3 from above.

FIG. 6 shows a view of a partition wall of a box according to the present invention.

FIG. 7 shows a side view of the partition wall in FIG. 6.

FIG. 8 shows a view of the partition wall in FIG. 6 from above.

Figure 2:
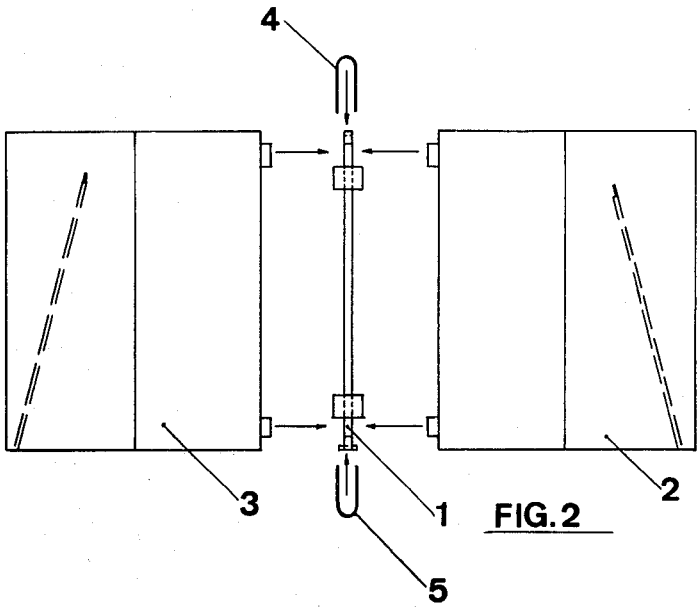
FIG. 2 shows a side view as shown in FIG. 1 wherein the parts are pushed apart from each other and arrows shows how to put the parts together.
Figure 1:
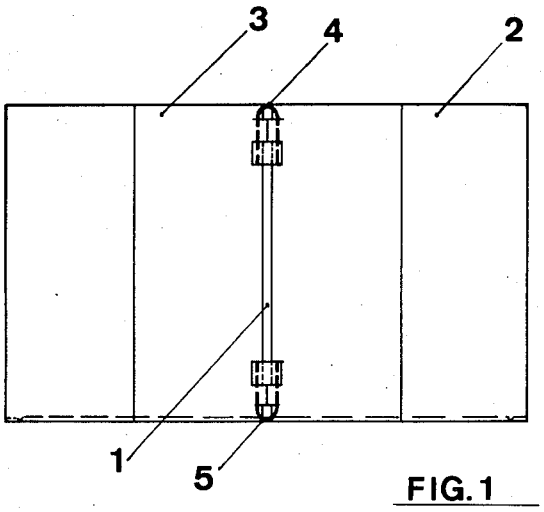
FIG. 1 shows a schematic side view of a box according to the present invention in raised position.

As shown in FIGS. 1 and 2, a box according to the present invention is provided with a partition wall 1, two wall-and-bottom assemblies 2 and 3, and hinge pin elements 4 and 5, each of which includes a pair of interconnected hinge pins. Naturally, there are two hinge pin elements 4, 5 on each side of the box.

A wall-and-bottom assembly 2, 3 is shown in greater detail in FIGS. 3–5 and consists of a main wall 6, a bottom 7 and two foldable walls 8 and 9, which are divided into two parts by film hinges 10 and 11. The foldable walls 8 and 9 are pivotally arranged on each side edge of the main wall 6 by film hinges 12 and 13 and the bottom 7 is pivotally arranged on the bottom edge of the main wall 6 by a film hinge 14 broken by two apertures 15 and 16. In order to have as strong as possible film hinges these should be broken.

The main wall 6 is provided with an aperture 17' forming a handgrip. The bottom 7 is provided with an aperture 18' forming a handgrip for lifting the bottom into the compartment in order to collapse the box as shown in broken lines in FIG. 2 and for forming a handgrip together with the handgrips of the other parts of the box in its collapsed position. Along the edge opposite the film hinge 14 the bottom 7 is provided with a supporting step 17 for resting on the partition wall 1 in the raised position. Each of the foldable walls 8 and 9 is provided with two shaft hinge parts 18, 19, 20 and 21 with holes for the shafts 4 and 5. Each of the foldable walls 8 and 9 is provided with a snap means 22 and 23.

As shown in FIGS. 6–8 the partition wall 1 is provided with an aperture 24 for forming a handgrip. On the upper side the aperture 24 is provided with a pad 25 providing a supporting surface for the hand of the person carrying the box, whereby a point load is avoided. At each side edge the partition wall 1 is provided with four shaft hinge parts 26, 27, 28 and 29, two cut outs 30, 31, 32 and 33 for the shaft hinge parts 18, 19, 20 and 21 of the foldable walls 8 and 9 and two snap cut outs 34, 35, 36 and 37 for the shafts 4 and 5. Along the bottom edge the partition wall 1 is provided with a supporting surface 38 on each side of the wall.

The box according to the present invention can suitably be manufactured from a suitable co-polymer or a poly-ethylene of HD-type. Preferable the wall and bottom element in FIGS. 3–5 is molded in one part in one tool and in one shot and the partition wall in FIGS. 6–8 is molded in another tool and in one shot. The different walls are connected to a box according to the present invention by one wall-and-bottom assembly 2, 3 connected by the shafts 4, 5 to each side of a partition wall 1 after swinging the bottom 7 to the position shown in FIG. 2. The box is collapsed by swinging the bottom 7 to a position parallel with the main wall 6, whereupon the foldable walls 8, 9 are folded into the compartment, whereby the snap means 22 and 23 extends into the apertures 15 and 16 and snaps the bottom 7. Thereby the box will be in the collapsed position.

All the wall parts and the bottom of the box can be provided with weight reducing holes in any known design. The film hinges can be pressed by a knife for achieving as thin as possible material in the film hinge thereby achieving a great strength. Profiles of aluminium can be snapped on the upper edge of the main wall 6 for achieving greater stability.

I claim:

1. A collapsible box with two compartments having a common partition wall and a pair of wall-and-bottom assemblies characterized in that the common partition wall is provided with means for connecting a wall-and-bottom assembly to each side of said partition wall, each of said wall-and-bottom assemblies comprising a main wall, foldable side walls and a bottom which is pivotally connected to the main wall at the underside of the main wall, each of said foldable side walls having a first side edge pivotally connected to said side edge of the main wall and having a second side edge engaged with a said connection means on the partition wall, each of said foldable side walls being formed of two sections which are pivotally connected together at a location between said side edges thereof.

2. The invention of claim 1, characterized in that the partition wall and the foldable walls are provided with means for supporting said bottom in its bottom forming position in the compartment.

3. The invention of claim 1, characterized in that the foldable walls are pivotally arranged by film hinges, that the bottom is pivotally arranged by at least one film hinge and that said means for connection are hinges provided with hinge pins.

4. The invention of claim 1, characterized in that the two sections of the foldable side walls are connected to each other by film hinges.

5. The invention of claim 2, characterized in that said means for supporting associated with said foldable side walls are provided with snap means engageable between the bottom and said foldable side walls.

* * * * *